United States Patent [19]

Otto

[11] 3,967,400

[45] July 6, 1976

[54] IDENTIFICATION CARD

[75] Inventor: Günther Siegfried Otto, Munich, Germany

[73] Assignee: G.A.O. Gesellschaft fur Automation und Organisation m.b.H., Germany

[22] Filed: Jan. 8, 1975

[21] Appl. No.: 539,430

Related U.S. Application Data

[63] Continuation of Ser. No. 338,043, March 5, 1973, abandoned.

[30] Foreign Application Priority Data

Mar. 16, 1972 Austria ..... 22210/72

[52] U.S. Cl. ..... 40/2.2; 283/7; 40/135

[51] Int. Cl.[2] ..... G09F 3/02

[58] Field of Search ..... 40/2.2, 135, 136; 283/7, 8 B, 9 R

[56] References Cited

UNITED STATES PATENTS

| | | | |
|---|---|---|---|
| 228,221 | 6/1880 | Sangster | 283/8 B |
| 2,285,806 | 6/1942 | Close | 283/9 R |
| 2,588,067 | 3/1952 | Whitehead | 40/2.2 |
| 3,245,697 | 4/1966 | Nugent | 40/2.2 |
| 3,412,493 | 11/1968 | French | 40/2.2 |
| 3,414,998 | 12/1968 | Berger | 283/7 |
| 3,533,176 | 10/1970 | Wetzberger | 40/2.2 |
| 3,755,935 | 9/1973 | Annenberg | 40/2.2 |

*Primary Examiner*—Louis G. Mancene
*Assistant Examiner*—Wenceslao J. Contreras
*Attorney, Agent, or Firm*—McGlew and Tuttle

[57] ABSTRACT

The card has means for protection against forgery and unauthorized use, and comprises a laminated structure consisting of an outer base layer, an intermediate layer and an outer cover layer. The base layer is a supporting layer of relatively thick transparent foil material providing the necessary durability, rigidity and a portion of the desired thickness of the card. The intermediate layer comprises special paper having zones of respectively different thickness distributed therein and discernable by visual and tactile inspection, and containing security and authenticity features such as water marks, colored threads and the like. The outer cover layer is a covering of transparent material sufficiently thin to conform to the different thicknesses of the intermediate layer, whereby the different thicknesses are accurately reproduced in the outer surface of the outer cover layer. The security and authenticity features may be embedded in the thickened portions of the intermediate layer.

11 Claims, 10 Drawing Figures

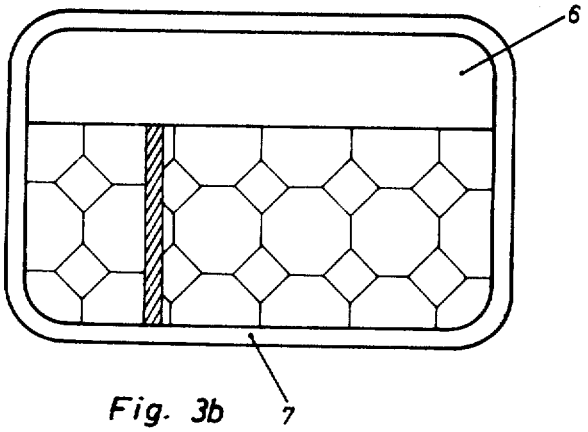
Fig. 3b
Fig. 4
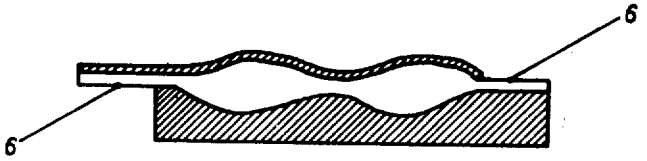
Fig. 5a
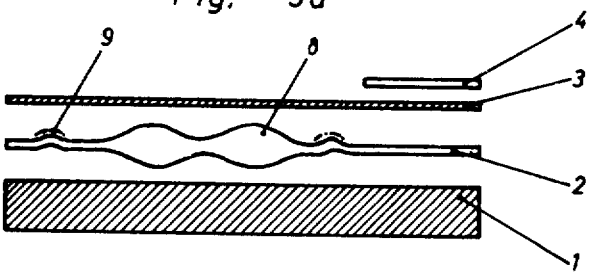

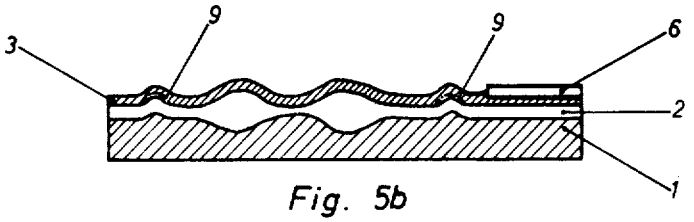
Fig. 5b
Fig. 6
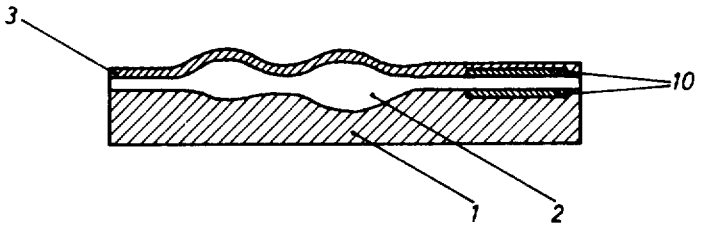
Fig. 7
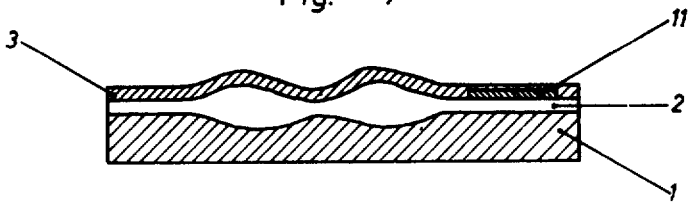
Fig. 8
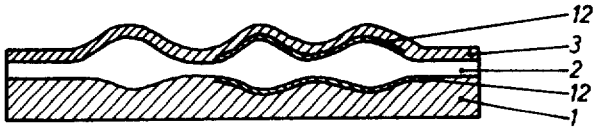

IDENTIFICATION CARD

This is a continuation of application Ser. No. 338,043, filed Mar. 5, 1973, now abandoned.

FIELD AND BACKGROUND OF THE INVENTION

The present invention has for its object an identification card made from laminated special paper having distinct authenticity features and providing special protection from forgery.

Such types of cards are known to be used, as data recording media bearing the information, for identity cards, credit cards, workshop cards, passports, and other similar means of identification which, to a great extent, must be proof against forgery and, at the same time, are required to permit an easy forge testing or proof of authenticity by human beings and/or machines.

Plastic cards of this kind, which are made either from solid plastics or from paper-like plastics which are heat-sealed with a plastics material, are well known to be in use as credit cards, cheque holder identity cards, and the like. Such cards are, to only a restricted extent, suitable for meeting the safety requirements placed thereon when used as a means of payment in combination with credit cards, or the like, or as an instrument in control and security systems, because they can easily be identically forged and this often without even causing any difficulties, and do not sufficiently safeguard the establishment of a quick and unambiguous proof of authenticity by everybody. The material itself which is used for manufacturing the cards has no distinct authenticity features whatsoever, i.e., no features of the kind customarily used for protecting other documents, such as bank notes, securities, passports, cheques, and the like, such as watermarks, security threads, and so on. Moreover, the material does not permit of any equivalent processing from a security point of view which would provide for an effective protection from prospective forgers on one hand, and permit an easy and unambiguous establishment of the proof of authenticity by human beings on the other hand, as does the usual type of safety print customary on securities or bank notes of corresponding quality. Inasfar as printing methods are used for applying the designations of organizations and symbols, identical counterfeiting or forgery is possible without causing any difdiculties by means of even the smallest high-quality printers (printing machines) customarily used in the profession.

SUMMARY OF THE INVENTION

It is the object of the invention to provide a plasticized identification card for the above mentioned purposes with the security-technical finish thereof, however, actually providing an effective protection against all kinds of forgery attempts, and which permits an easy and unambiguous optical and mechanical as well as manual forge testing.

The invention, therefore, is concerned with an identification or identity card. According to the basic idea of invention, the card consists of a relatively thick supporting foil material and of a thin transparent sheet between which a special paper is disposed, containing security and authenticity features, such as watermarks, bank note printing, or the like, by which the card is made proof against forgery, and by which differences are caused in the thickness of the paper, with all three of these layers being laminated in such a way with one another that the inserts and the thickness variation are detectable through the transparent sheet either manually, mechanically and/or visually. Finally still further features serving the identification of the card holder are provided for in the manner known per se and on suitable portions of the card.

In various systems which are in practical use today, handwritten records must still be made on the finished plasticized card, such as a signature for checking the identity of the user of the cheque or credit card, with such records having to be protected from forgery and falsification. For this purpose, a strip of special paper having distinct security properties and being provided with a printing of the type customarily used on securities, etc., is bonded or laminated on the front or rear side of the identification card, in a manner similar to the known German cheque holder identity cards.

In case a signature field is required on that particular side of the card having a noticeable relief or plasticity perceptible through the thinner transparent sheet, a corresponding strip of the special intermediate paper is left free while the remaining paper is laminated with the thin transparent sheet material. The signature may thus be executed thereafter on the original recording medium in order to increase security still further.

For special purposes, such as on workshop cards for employees of industrial firms, which are required to meet high security standards, a photograph in the form of a film diapositive may be laminated between the special paper layer and one of the transparent sheets. By correspondingly designing the type of printing and by placing the photograph accordingly, both the security printing and the photograph, after lamination, not only form a physical unit but also form an optical unit which is of very great value from a security point of view, and which does not impair the steps to be taken for detecting authenticity of both the photograph and the security print on the card.

With respect to certain types of identity card systems, the special paper itself, which is provided with a printing considered to be of high quality from a security point of view, may be used as a picture support in that a photographic layer is deposited either prior to or after laminating the one side of the card which is not intended to serve as such a support. Final laminating is then carried out subsequently to the exposure, development and fixing.

A further type of embodiment in which the security printing on the special insert paper is combined with a photograph in the form of a film diapositive, resides in depositing a photographic layer either on the thinner or the thicker side, or on both sides, of the transparent sheets facing the special paper. Subsequently to the exposure, the development and the fixing, the special paper is laminated, with a firm connection being established between the latter and the information which is either in the form of a half-tone diapositive (e.g., personal photograph), or in the form of photographically represented characters and/or symbols as contained in the transparent sheet material. This type of embodiment permits centralized administration, and to laminate the special insert material already provided with the security printing, as well as the decentralized preparation of the information recording media which are to be combined therewith.

The invention will now be described in detail and by way of example with reference to the accompanying drawings.

BRIEF DESCRIPTION OF THE DRAWINGS

In the drawings:

FIGS. 3*a* and 3*b* show two examples of the identification card according to the invention in a top view, FIG. 4 shows a further example of embodiment of the subject matter of the invention, and FIGS. 5*a*, 5*b* and 6 to 8 show two further examples of embodiment, with the respective identification cards being shown in cross-sectional views.

In referring to these drawings, FIG. 1 shows a cross-sectional view of the laminated identification card. The identification card consists of the thicker transparent sheet 1, of the special paper 2 provided with a printing which is of high quality from a security point of view, with this special paper 2 having differences in thickness and containing watermarks and/or additionally inserted distinct security features, as well as of the thinner transparent sheet 3. For the sake of clarity and for enabling a better understanding, the three layers are shown to be somewhat apart.

Figure 1:
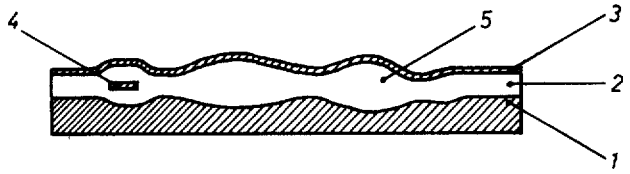
FIG. 1 shows the identification card according to the invention in a cross-sectional view.

The thicker transparent sheet 1 serves as the supporting foil material for giving the identity or identification card the necessary durability and rigidity and, to some extent, also the desired thickness. The supporting foil material 1 may optionally represent either the front or the rear side of the plasticized identification card.

The thinner transparent sheet 3 serves as the cover foil and may optionally likewise form either the front or the rear side of the identification card. The cover foil 3 provides durability for the other side of the laminated special paper, as well as the necessary surface protection, so that the stamping (coining or embossing) of data may be carried out with the aid of conventional machines customarily used in the profession, and the finished or readily stamped identification card can be used as a printing plate for producing further prints therefrom. The cover foil 3, owing to its small thickness and high degree of elasticity, safeguards the unambiguously visible and perceptible reproduction of the finest differences in thickness and the finest line (guilloche) pattern in the bank note type of printing, of or on the special paper 2 respectively. In an easy and unambiguous manner this enables to detect the genuineness and to carry out forge testing, either by way of touching or feeling and visible inspection by human beings, on one hand, or with the aid of suitable machines, on the other hand.

The special paper 2 serves as the means for carrying the actual security and authenticity features. This special paper 2, as provided with the distinct security and authenticity features, such as the visible and perceptible watermark 4, the security thread 5, and/or similar substances, is provided with a printed guilloche pattern as is customarily used on securities or bank notes, either on one or on both sides thereof.

Laminating is effected by joining the special paper 2 to the supporting foil material 1 and the cover foil 3, and by the simultaneous application of heat and pressure.

Figure 2:
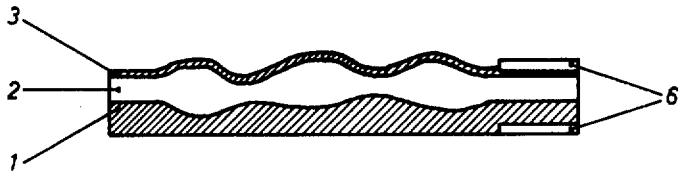
FIG. 2 shows the cross section of an identification card provided with a signature field.

FIG. 2 shows the cross-sectional view of an identification card with a signature field 6 as additionally provided on the outside. The signature field 6 consists of special paper which is thinner than the laminated special paper 2 disposed between the supporting foil material 1 and the cover foil 3. This signature field 6, before being laminated, is likewise provided with the security type of printed guilloche pattern, and may be positioned in any suitable portion on either the front or the rear side of the card. In the course of the laminating process, the signature field 6 is firmly joined to the supporting foil material 1 or to the cover foil 3 and, in so doing, is partly embedded in the plastics material, i.e., more in the supporting foil material 1 than in the material of the cover foil 3.

Figure 3A:
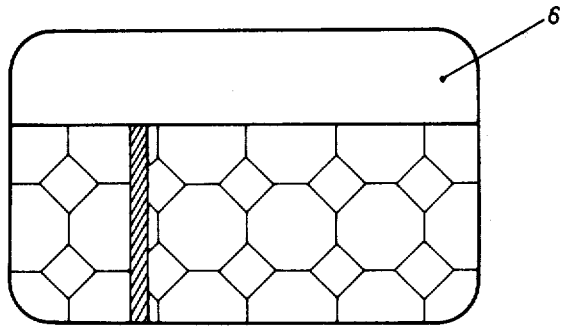

FIGS. 3*a* and 3*b*, in a schematical representation, show top views of two different identification cards both according to the invention:

FIG. 3*a* shows a laminated identification card on which the supporting foil material 1, the special paper 2, the cover foil 3 and the signature field 6 have been laminated without causing any rim portion (margin), and FIG. 3*b* shows the top view of a laminated identification card on which the supporting foil material 1 and the cover foil 3 form a rim portion (margin) 7 projecting on all sides over both the laminated special paper 2 and the signature field 6.

FIG. 4 shows a modified type of signature field 6. In this modification, no additional strip of special paper is placed on the card while being laminated, i.e., the signature field 6 is left free in the cover foil 3 during the laminating process.

FIG. 5*a* again shows a cross-sectional view of the individual constituent parts, namely of the supporting foil material 1, the special paper 2, the cover foil 3, and the signature field 6 before being laminated. The differences in thickness, as contained in the special paper 2, are indicated by the wavy lines 8. The additional differences in thickness, caused by the print design resembling that of bank notes, are indicated by the dot-and-dash lines 9.

FIG. 5*d* shows a cross-sectional view taken through the same type of identification card after being laminated, indicating the differences in thickness caused by the cover foil 3.

FIG. 6 shows a cross-sectional view of the inventive type of identification card together with the additionally laminated personal photograph in the form of a film diapositive 10. x)

x) The film diapositive 10 is after exposing to light, developing and fixing inserted between the supporting foil material 1 and the special paper 2 or between the special paper 2 and the cover foil 3 and then laminated.

For the use in connection with certain types of identity card systems, the already printed special paper 2, according to FIG. 7, before being laminated, or preferably after one side has been laminated with the supporting foil material 1, is coated with a photographic layer 11, whereupon it is exposed to light, developed and fixed. Accordingly, in this way the special paper 2 contains the security-technical print design for serving as a protection from forgery and as a means for detecting authenticity (genuineness), combined with photographically recorded information 1 in the form of pictures and/or data.

FIG. 8 shows a modified type of inventive identification card, combined with photographs in the form of film diapositives. Before being laminated, one of the two transparent sheets, preferably the cover foil 3, is provided with a photographic layer 12 on the side facing the special paper 2, and thereafter exposed, developed and fixed. During laminating, a firm connection is established between the special paper 2 with the security-technical print thereon, and the cover foil 3 supporting the photograph in the form of a film diapositive and/or the supporting foil material 1. The visible and perceptible reproduction of the differences in thickness in or on the special paper 2 respectively, caused by the cover foil 3, is not affected by the photographic layer 12.

What is claimed is:

1. An identification card comprising a laminated structure consisting of an outer base layer, an intermediate layer and an outer cover layer; said base layer comprising a supporting layer of relatively thick transparent foil material providing the necessary durability, rigidity and a portion of the desired thickness of said card; said intermediate layer comprising special paper having zones of respectively different thicknesses distributed therein and discernable by visual and tactile inspection, and containing security and authenticity features; said outer cover layer comprising a covering of transparent material sufficiently thin to conform to the different thicknesses of said intermediate layer, whereby said different thicknesses are accurately reproduced in the outer surface of said cover layer for such visual and tactile inspection.

2. An identification card according to claim 1, in which at least one additional layer comprising special paper serving as a field reserved for the subsequent execution of signatures and other hand-written records, is laminated to the outside of said card.

3. An identification card according to claim 1, in which at least one section on at least one side of said card is not covered completely by the outer layer for permitting subsequent records to be made directly on said intermediate layer.

4. An identification card according to claim 1, in which said intermediate layer is coated on at least one side with at least one photographic layer adapted to be thereafter exposed, developed and fixed.

5. An identification card according to claim 1, wherein said card includes a marginal area across the top thereof having a synthetic material field area with a security type printed pattern.

6. A card according to claim 5, including an area across the bottom thereof with a signature area having a security type printed pattern thereon.

7. A card according to claim 6, wherein said security area is formed only in an area of said intermediate layer and the outer layer and extends beyond the base layer.

8. A security card according to claim 1, wherein said intermediate layer includes a plurality of print designs thereon, said print designs being visible through said outer layer.

9. A card according to claim 1, including a film diapositive, which has been exposed to light and developed, inserted between said base layer and said intermediate layer, all of said layers being laminated together.

10. An identification card according to claim 1, in which said security and authenticity features are inserts in the thicker portions of said special paper.

11. An identification card according to claim 1, in which said intermediate layer has one surface thereof initially laminated to an outer layer, is then coated with a photographic layer, and then has its other surface laminated to the other outer layer, and is thereafter exposed, developed and fixed.

* * * * *